US011309671B2

(12) United States Patent
Liao

(10) Patent No.: US 11,309,671 B2
(45) Date of Patent: Apr. 19, 2022

(54) CONNECTING STRUCTURE AND ADAPTER

(71) Applicant: GUANGDONG GOPOD GROUP HOLDING CO., LTD., Shenzhen (CN)

(72) Inventor: Zhuowen Liao, Shenzhen (CN)

(73) Assignee: Guangdong Gopod Group Holding Co., Ltd., Shenzhen (CN)

( * ) Notice: Subject to any disclaimer, the term of this patent is extended or adjusted under 35 U.S.C. 154(b) by 0 days.

(21) Appl. No.: 16/615,364

(22) PCT Filed: Nov. 12, 2018

(86) PCT No.: PCT/CN2018/115050
§ 371 (c)(1),
(2) Date: Nov. 20, 2019

(87) PCT Pub. No.: WO2020/097759
PCT Pub. Date: May 22, 2020

(65) Prior Publication Data

US 2021/0336395 A1 Oct. 28, 2021

(51) Int. Cl.
*H01R 13/60* (2006.01)
*H01R 31/06* (2006.01)
*H01R 13/73* (2006.01)

(52) U.S. Cl.
CPC ..... *H01R 31/06* (2013.01); *H01R 13/73* (2013.01)

(58) Field of Classification Search
CPC ..... H01R 13/73; H01R 31/06
(Continued)

(56) References Cited

U.S. PATENT DOCUMENTS 3,293,589 A * 12/1966 Oakes ..... H01R 31/06 439/268
4,878,848 A * 11/1989 Ingalsbe ..... H01R 31/06 439/76.1

(Continued)

FOREIGN PATENT DOCUMENTS

CN 202488512 U 10/2012
CN 103326180 A 9/2013

(Continued)

OTHER PUBLICATIONS

International Search Report and Written Opinion for Application No. PCT/CN2018/115050, dated Aug. 16, 2019.

*Primary Examiner* — Abdullah A Riyami
*Assistant Examiner* — Vladimir Imas
(74) *Attorney, Agent, or Firm* — Wolf, Greenfield & Sacks, P.C.

(57) ABSTRACT

A connecting structure comprising: a connecting plate that has an abutting surface abutting with an electronic device and a fixing surface abutting with an adapter, a first fixing plate arranged at one end of the connecting plate, the first fixing plate protruding towards the electronic device from the abutting surface; and a second fixing plate arranged at the other end of the connecting plate, the second fixing plate protruding towards the electronic device from the abutting surface, wherein the second fixing plate is arranged opposite to the first fixing plate to define an accommodating slot for receiving an end of the electronic device having an interface. The connecting structure and the adapter reinforce the connection force between the plug and the interface, thus reducing the possibility of separation and preventing the plug from being broken.

20 Claims, 10 Drawing Sheets

(58) Field of Classification Search
USPC ..... 439/533
See application file for complete search history.

(56) References Cited

U.S. PATENT DOCUMENTS

| | | | | |
|---|---|---|---|---|
| 5,479,479 | A * | 12/1995 | Braitberg | H01R 31/06 455/404.1 |
| 6,424,525 | B1 * | 7/2002 | MacLeod | G06F 1/16 312/223.1 |
| 6,547,602 | B2 * | 4/2003 | Price | H01R 27/02 439/638 |
| 6,669,513 | B2 * | 12/2003 | Huang | G06F 1/266 361/679.4 |
| 8,143,848 | B2 * | 3/2012 | Navid | H02J 7/0045 320/113 |
| 8,378,630 | B2 * | 2/2013 | Navid | H01R 31/06 320/113 |
| 8,480,416 | B2 * | 7/2013 | Farris-Gilbert | H01R 31/06 439/131 |
| 8,545,269 | B2 * | 10/2013 | Ore-Yang | H01R 13/6658 439/620.22 |
| D740,291 | S * | 10/2015 | Turksu | D14/433 |
| 9,715,472 | B2 * | 7/2017 | Chang | G06F 13/4022 |
| 9,979,147 | B1 * | 5/2018 | Huang | H01R 25/006 |
| 9,991,657 | B2 * | 6/2018 | Powers | H01R 31/06 |
| 10,199,791 | B2 * | 2/2019 | Logvinov | H01R 31/06 |
| D891,433 | S * | 7/2020 | Chin | D14/433 |
| 10,978,841 | B2 * | 4/2021 | Liao | H01R 13/6658 |
| 2003/0216069 | A1 * | 11/2003 | Huang | G06F 13/409 439/105 |
| 2016/0240971 | A1 | 8/2016 | Fan et al. | |

FOREIGN PATENT DOCUMENTS

| | | | |
|---|---|---|---|
| CN | 204407658 | U | 6/2015 |
| CN | 107275835 | A | 10/2017 |

* cited by examiner

CONNECTING STRUCTURE AND ADAPTER

RELATED APPLICATIONS

This application is a 371 National Stage application claiming priority to International Application No. PCT/CN2018/115050, filed Nov. 12, 2018. The aforementioned application is incorporated herein by reference, in its entirety, for any purposes.

TECHNICAL FIELD

The invention relates to the technical field of adapters, and in particular to a connecting structure and an adapter.

BACKGROUND ART

At present, most of commercially available adapters for expanding an interface of an electronic device are connected to the interface by means of a plug on the adapter and are fixed to the plug. However, during use, the connection between the plug and the interface is easy to get loose to cause connection failed between them. Moreover, when the plug is fixedly connected to the interface, a user sometimes moves the electronic device, and the adapter is easy to be bumped during the movement to cause the plug to be broken in the interface, which not only damages the adapter, but also possibly damages the interface of the electronic device.

SUMMARY OF THE INVENTION

An object of the present invention is to provide a connecting structure to solve the problem in the prior art that a plug of an adapter is easy to be broken.

In order to achieve the above purpose, the technical solution adopted in the present invention involves a connecting structure comprising: a connecting plate that has an abutting surface abutting with an electronic device and a fixing surface abutting with an adapter;

a first fixing plate arranged at one end of the connecting plate, the first fixing plate protruding towards the electronic device from the abutting surface; and a second fixing plate arranged at the other end of the connecting plate, the second fixing plate protruding towards the electronic device from the abutting surface, wherein the second fixing plate is arranged opposite to the first fixing plate, an accommodating slot for receiving an end of the electronic device having an interface is formed among the first fixing plate, the second fixing plate and the connecting plate, and the accommodating slot is fitted at the end of the electronic device having an interface; and the connecting plate is provided with a plug hole through which a plug passes and the plug protrudes towards the electronic device.

In one embodiment, the first fixing plate is inclined relative to the connecting plate, and the second fixing plate is inclined relative to the connecting plate.

In one embodiment, the first fixing plate is arranged to protrude towards the inside of the accommodating slot, and the second fixing plate is arranged to protrude towards the inside of the accommodating slot.

In one embodiment, the first fixing plate is parallel to the second fixing plate, the first fixing plate is arranged to protrude towards the outside of the accommodating slot, and the second fixing plate is arranged to protrude towards the inside of the accommodating slot.

In one embodiment, the first fixing plate is parallel to the second fixing plate, the first fixing plate is arranged to protrude towards the inside of the accommodating slot, and the second fixing plate is arranged to protrude towards the outside of the accommodating slot.

In one embodiment, the first fixing plate is parallel to the second fixing plate, and the first fixing plate and the second fixing plate are respectively arranged perpendicular to the connecting plate.

In one embodiment, the first fixing plate is provided with a first fixing protrusion towards the inside of the accommodating slot, and the second fixing plate is provided with a second fixing protrusion towards the inside of the accommodating slot.

In one embodiment, a corner of the first fixing plate is provided with a first chamfer, and a corner of the second fixing plate is provided with a second chamfer.

In one embodiment, a lateral side of the first fixing plate facing the electronic device is provided with a third chamfer, and a lateral side of the second fixing plate facing the electronic device is provided with a fourth chamfer.

In one embodiment, the electronic device comprises two overlapped components with a gap formed therebetween, the length of the first fixing plate in the protruding direction is greater than the length of the second fixing plate in the protruding direction, and the length of the second fixing plate is less than the depth of the gap.

In one embodiment, the thickness of the second fixing plate is less than the width of the gap of the electronic device.

Another object of the present invention is to provide an adapter comprising the connecting structure as described above and an adapter apparatus fixedly connected to the connecting structure, the adapter apparatus being provided with an interface apparatus and a plug connected to the interface apparatus.

In one embodiment, the plug protrudes out of an end of the first fixing plate by 2 mm to 5 mm.

In one embodiment, the methods for fixing the connecting structure to the adapter apparatus include fixing with an adhesive, snap-fit fixing, fixing with a screw, or fixing by welding.

In one embodiment, the interface apparatus comprises at least one of a USB-Type-C interface, a USB-Type-B interface, a TF card interface, an audio interface and an HDMI interface.

The connecting structure provided in the present invention has the beneficial effects in that:

firstly, a connecting structure is fixedly arranged on an adapter, an accommodating slot is formed among a first fixing plate, a second fixing plate and a connecting plate, and the accommodating slot is used for receiving an end of an electronic device having an interface and is sized to adapt to the end of the electronic device, that is, the first fixing plate and the second fixing plate clamp or abut against the end of the electronic device, and the clamping force applied by the first fixing plate and the second fixing plate is superposed on a connecting force between a plug and the interface itself, further reinforcing the connecting force between the plug and the interface at the end of the electronic device, thus preventing the accidental separation of the plug and the interface; secondly, the first fixing plate and the second fixing plate protruding out of the connecting plate can share the force applied to the plug in the vertical fixing direction due to bumping of the adapter, so as to avoid the damage to the plug caused by the plug being bent due to an excessive force; and finally, the connecting structure can be fixedly arranged on any adapter having a plug, thus facilitating modifying the existing adapter to prevent the plug from being broken and prolong the service life of the plug.

Figure 1:
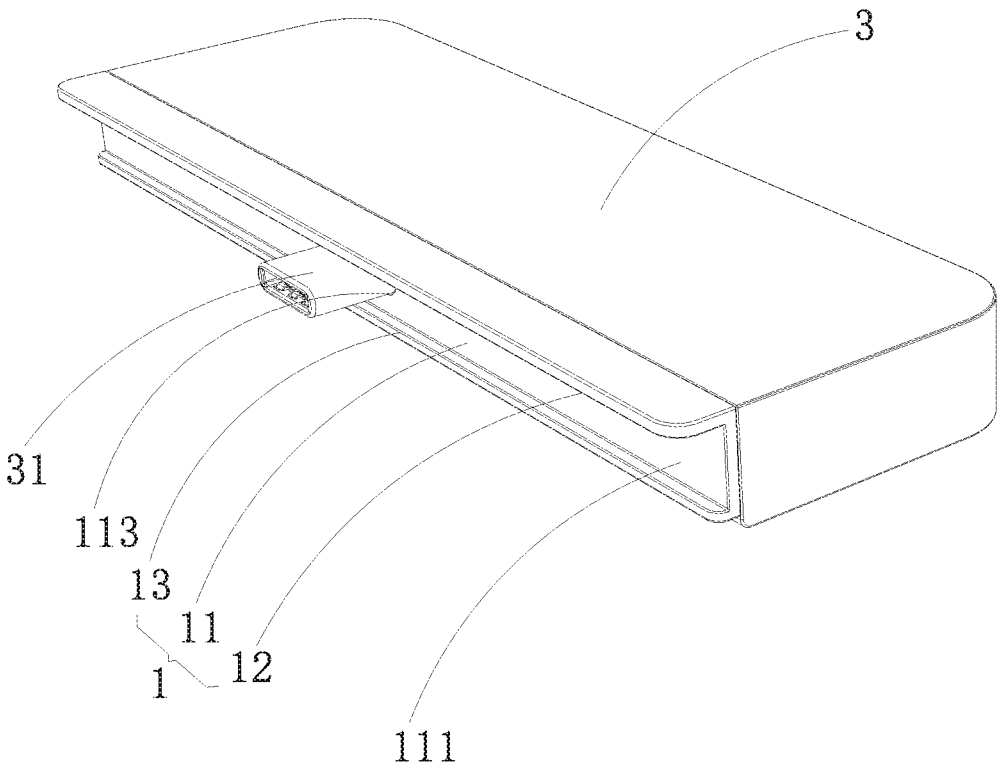
FIG. 1 is a perspective structural view of a connecting structure provided in a first embodiment of the present invention.

Reference signs in the drawings are as follows:

| | | | | | |
|---|---|---|---|---|---|
| Connecting structure | 1 | Plug | 31 | Adapter apparatus | 32 |
| Connecting plate | 11 | Plug hole | 113 | USB-Type-C interface | 321 |
| Abutting surface | 111 | First fixing protrusion | 121 | USB-Type-B interface | 322 |
| Fixing surface | 112 | Second fixing protrusion | 131 | TF card interface | 323 |
| Tablet computer | 2 | First chamfer | 122 | Audio interface | 324 |
| Adapter | 3 | Second chamfer | 132 | Third chamfer | 123 |
| First fixing plate | 12 | Notch | 141 | Fourth chamfer | 133 |
| Second fixing plate | 13 | Keyboard assembly | 4 | Interface apparatus | 33 |
| Accommodating slot | 14 | Gap | 5 | | |

DETAILED DESCRIPTION OF EMBODIMENTS

In order to make the technical problems to be solved by the present invention, the technical solutions and the beneficial effects clearer, the present invention will be described in further detail below with reference to the drawings and embodiments. It should be understood that the specific embodiments described herein are merely used to explain the present invention, but not intended to limit the present invention.

It should be noted that when an element is referred to as being "fixed to" or "arranged at" a further element, it can be directly located on the further element or indirectly located on the further element. When an element is referred to as being "connected to" a further element, it can be directly connected or indirectly connected to the further element.

It should be understood that the orientation or positional relationship indicated by the terms "length", "width", "upper", "lower", "front", "rear", "left", "right", "vertical", "horizontal", "top", "bottom", "inner" and "outer" are based on the orientation or positional relationship as shown in the drawings and are to facilitate the description of the present invention, rather than indicating that the apparatus or element must have a particular orientation or be constructed and operated in a particular orientation, and thus will not be interpreted as limiting the present invention.

Furthermore, the terms "first" and "second" are used for descriptive purposes only and cannot be construed as indicating relative importance or indicating the number of technical features. In the description of the present invention, the word "multiple" means two or more, unless otherwise specifically defined. The specific implementation of the present invention will be described in more detail below with reference to particular embodiments:

FIGS. 1 to 10 show a connecting structure provided in an embodiment of the present invention.

As shown in FIGS. 1 to 3 and FIG. 10, an embodiment of the present invention provides a connecting structure 1 comprising a connecting plate 11, the connecting plate 11 having an abutting surface 111 abutting with an electronic device 2 and a fixing surface 112 abutting with an adapter 3;

a first fixing plate 12 arranged at one end of the connecting plate 11, the first fixing plate 12 protruding towards the electronic device 2 from the abutting surface 111; and a second fixing plate 13 arranged at the other end of the connecting plate 11, the second fixing plate 13 protruding towards the electronic device 2 from the abutting surface 111, wherein the second fixing plate 13 is arranged opposite to the first fixing plate 12, an accommodating slot 14 for receiving an end of the electronic device 2 having an interface is formed among the first fixing plate 12, the second fixing plate 13 and the connecting plate 11, and the accommodating slot 14 is fitted at the end of the electronic device 2 having an interface; and the connecting plate 11 is provided with a plug hole 113 through which a plug 31 of the adapter 3 passes and the plug 31 protrudes towards the electronic device 2.

The principle of use of this embodiment is as follows:

the connecting structure 1 is fixedly connected to the adapter 3, and the methods for fixed connection include, but not limited, bonding, threaded fixing, welding, or integral forming of the connecting structure and the adapter. The electronic device 2 abutting with the adapter 3 comprises, but not limited, a tablet computer 2 or a mobile phone, and this embodiment will be described with the tablet computer 2 as an example. The plug 31 on the adapter 3 passes through the plug hole 113 and protrudes towards the tablet computer 2, and then the connecting structure 1 can be engaged with the tablet computer 2, an end of the tablet computer 2 having an interface is inserted into the accommodating slot 14, with the plug 31 correspondingly abutting with the interface, and the first fixing plate 12 and the second fixing plate 13 clamp the end of the tablet computer 2, thus the connection being completed.

The connecting structure 1 provided in the present invention has the following effects:

firstly, a connecting structure 1 is fixedly arranged on an adapter 3, an accommodating slot 14 is formed among a first fixing plate 12, a second fixing plate 13 and a connecting plate 11, and the accommodating slot 14 is used for receiving an end of an electronic device 2 having an interface and is sized to adapt to the end of the electronic device 2, that is, the first fixing plate 12 and the second fixing plate 13 clamp or abut against the end of the electronic device 2, and the clamping force applied by the first fixing plate 12 and the second fixing plate 13 is superposed on a connecting force between a plug 31 and the interface itself, further reinforcing the connecting force between the plug 31 and the interface at the end of the electronic device 2, thus preventing the accidental separation of the plug and the interface; secondly, the first fixing plate 12 and the second fixing plate 13 protruding out of the connecting plate 11 can share the force applied to the plug 31 in the vertical fixing direction due to bumping of the adapter 3, so as to avoid the damage to the plug 31 caused by the plug 31 being bent due to an excessive force; and finally, the connecting structure 1 can be fixedly arranged on any adapter 3 having a plug 31, thus facilitating modifying the existing adapter 3 to prevent the plug 31 from being broken and prolong the service life of the plug 31.

Further, the first fixing plate 12 is inclined relative to the connecting plate 11, and the second fixing plate 13 is inclined relative to the connecting plate 11. The accommodating slot 14 is fitted to the end of the tablet computer 2, and the existing tablet computer has various shapes of the end, including a round end, a right-angled end or an oblique-angled end, and the first fixing plate 12 and the second fixing plate 13 form oblique angles with the connecting plate 11 to adapt to the various shapes of the end of the tablet computer 2.

Figure 4:
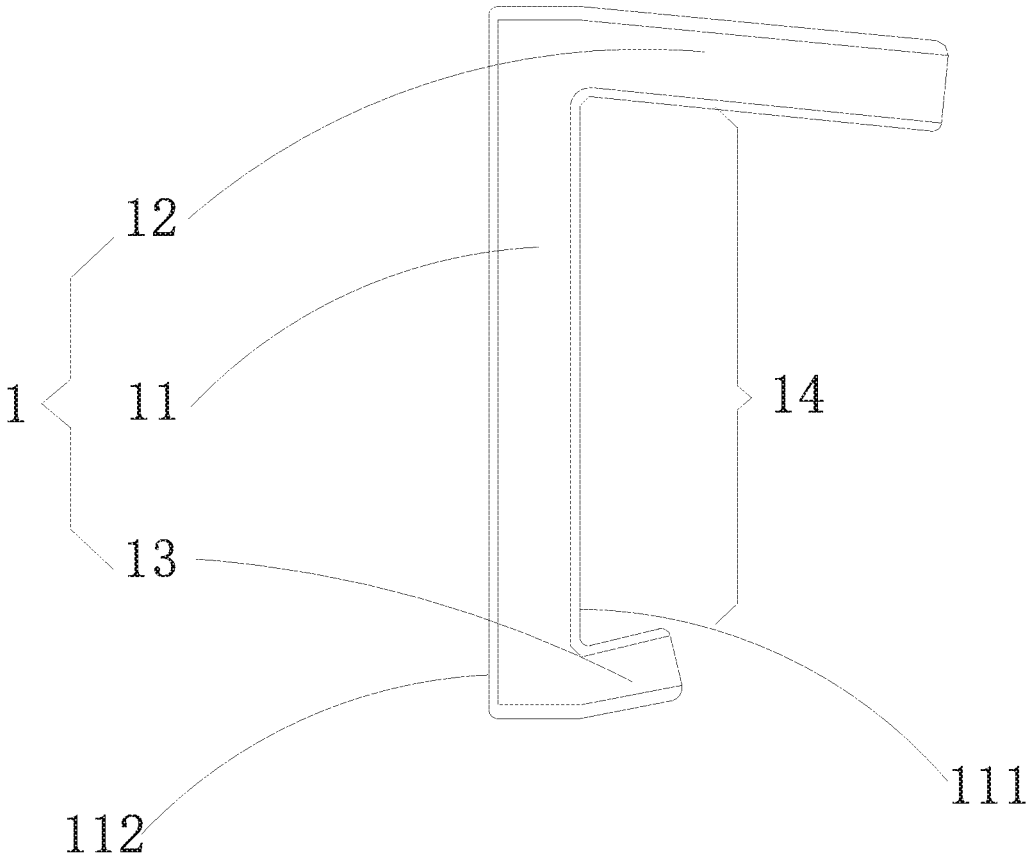
FIG. 4 is a left view of a connecting structure provided in a second embodiment of the present invention.

Optionally, as shown in FIG. 4, the first fixing plate 12 and the second fixing plate 13 are arranged towards the inside of the accommodating slot 14. The first fixing plate 12 and the second fixing plate 13 are folded towards the inside of the accommodating slot 14 to provide a greater clamping force, so that the connection between the connecting structure 1 and the tablet computer 2 is more stable.

Figure 5:
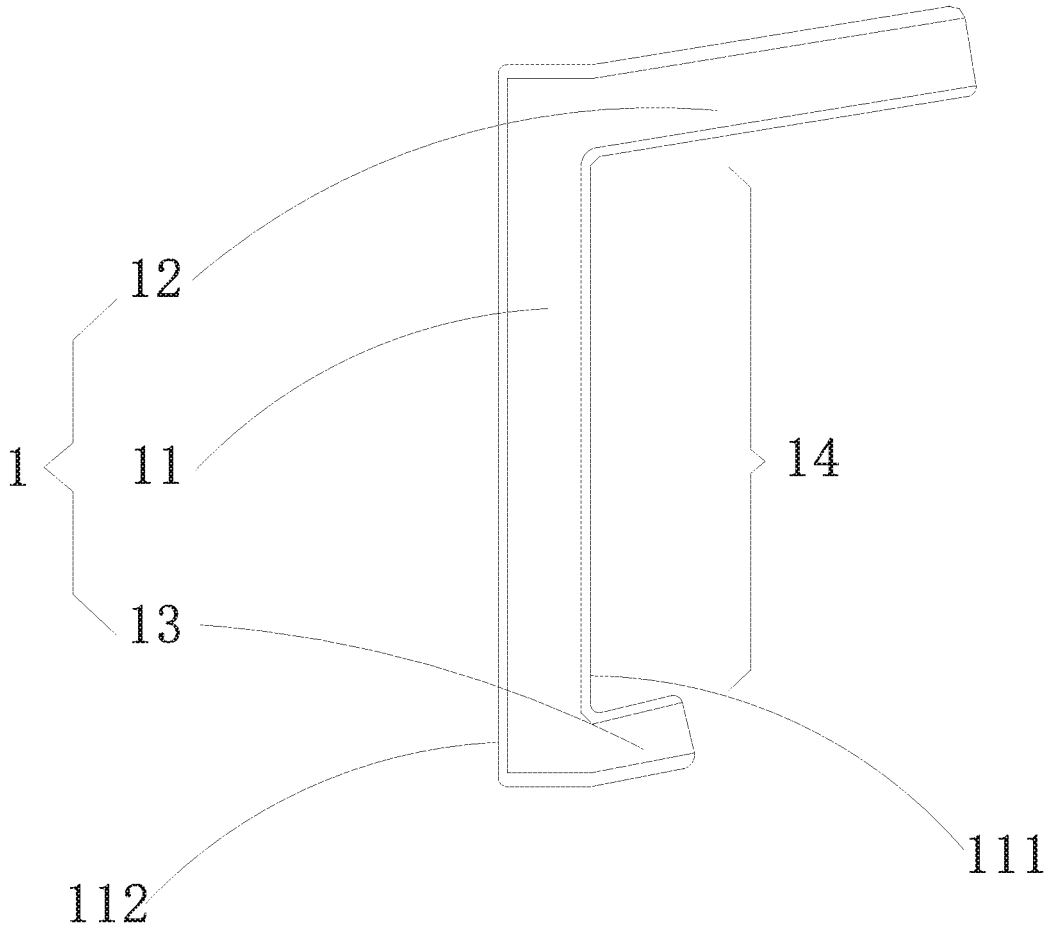
FIG. 5 is a left view of a connecting structure provided in a third embodiment of the present invention.

Optionally, as shown in FIG. 5, the first fixing plate 12 is parallel to the second fixing plate 13, the first fixing plate 12 is arranged to protrude towards the outside of the accommodating slot 14, and the second fixing plate 13 is arranged to protrude towards the inside of the accommodating slot 14. The first fixing plate 12 and the second fixing plate 13 form equal angles with the plane where the connecting plate 11 is located, and the first fixing plate 12 is inclined relative to the second fixing plate 13 to adapt to the oblique-angled end of the tablet computer 2.

Figure 6:
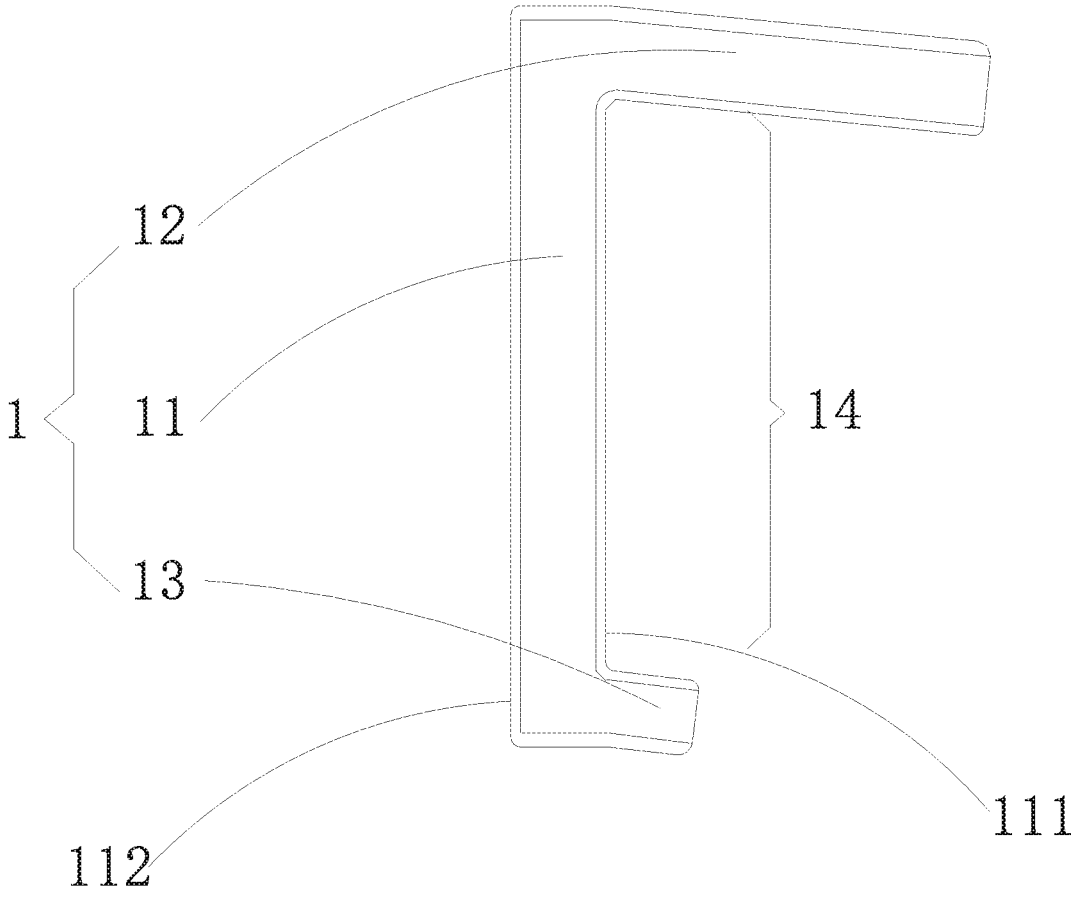
FIG. 6 is a left view of a connecting structure provided in a forth embodiment of the present invention.

Optionally, as shown in FIG. 6, the first fixing plate 12 is parallel to the second fixing plate 13, the first fixing plate 12 is arranged to protrude towards the outside of the accommodating slot 14, and the second fixing plate 13 is arranged to protrude towards the inside of the accommodating slot 14. The first fixing plate 12 and the second fixing plate 13 form equal angles with the plane where the connecting plate 11 is located, and the first fixing plate 12 is inclined relative to the second fixing plate 13 to adapt to the oblique-angled end of the tablet computer 2.

Optionally, referring to FIG. 2 again, the first fixing plate 12 is parallel to the second fixing plate 13, and the protruding direction of the first fixing plate 12 and the protruding direction of the second fixing plate 13 are respectively perpendicular to the connecting plate 11. The first fixing plate 12 and the second fixing plate 13 are arranged perpendicular to the connecting plate 11 to adapt to the right-angled end of the tablet computer 2.

Further, the first fixing plate 12 is provided with a first fixing protrusion 121 towards the inside of the accommodating slot 14, and the second fixing plate 13 is provided with a second fixing protrusion 131 towards the inside of the accommodating slot 14, or only one of the fixing plates is provided with a fixing projection. The friction force between the ends of the fixing plate connected to the tablet computer 2 can be increased by providing the fixing protrusions, thus improving the anti-separation effect.

Figure 7:
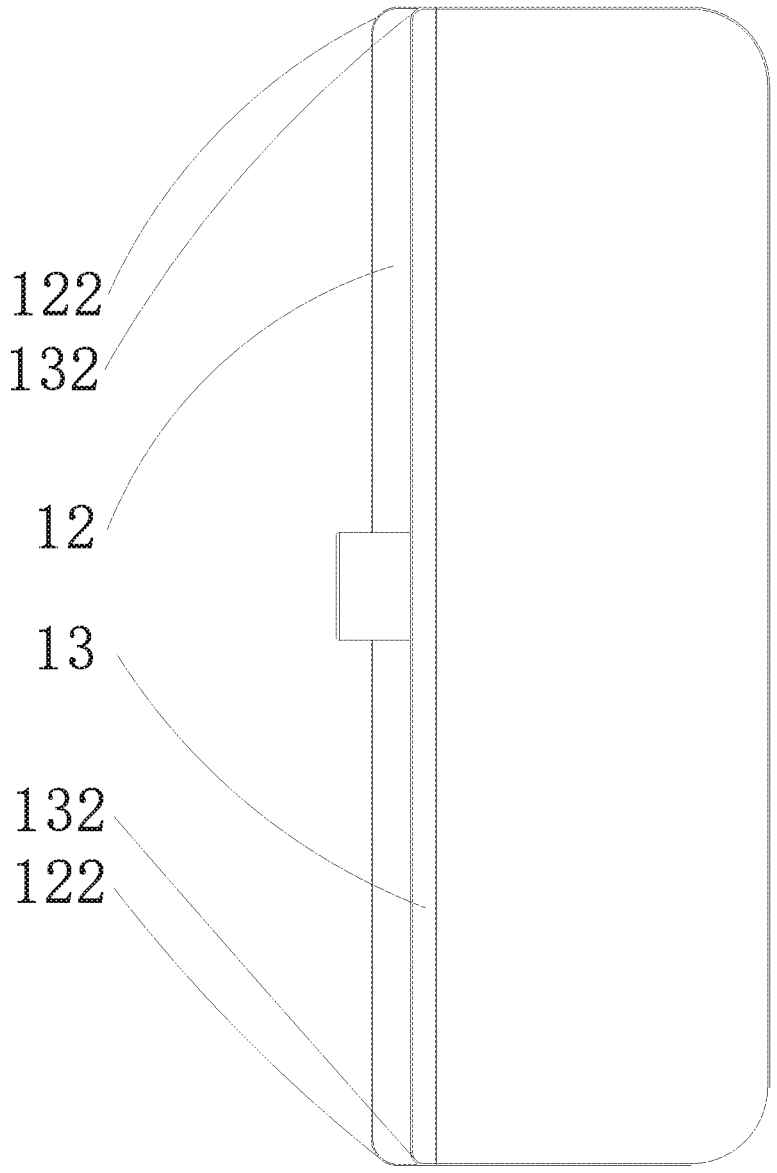
FIG. 7 is a bottom view of the connecting structure provided in the first embodiment of the present invention.

Further, as shown in FIG. 7, a corner of the first fixing plate 12 is provided with a first chamfer 122, and a corner of the second fixing plate 13 is provided with a second chamfer 132, or only one of the fixing plates is provided with a chamfer. Providing the chamfers can protect users from being injured by the sharp right-angle during use.

Figure 8:
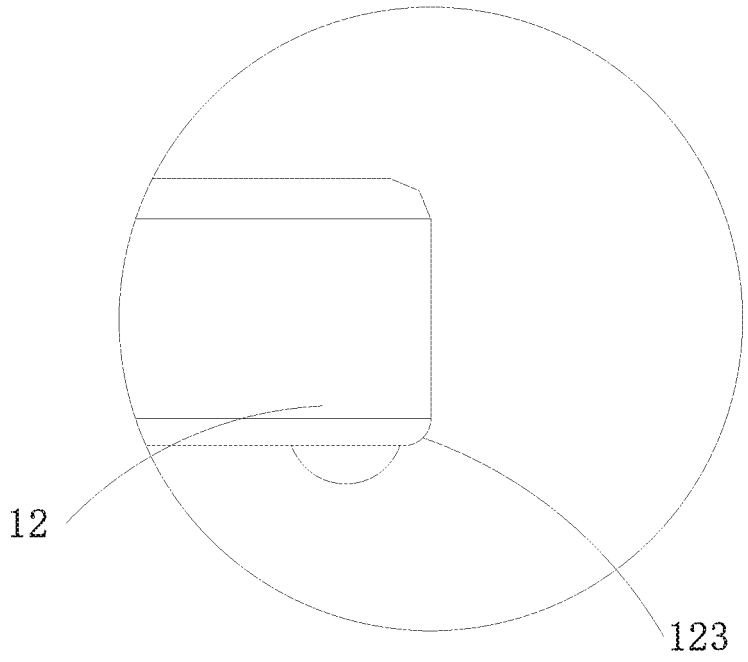
FIG. 8 is an enlarged view at "A" in FIG. 2.
Figure 9:
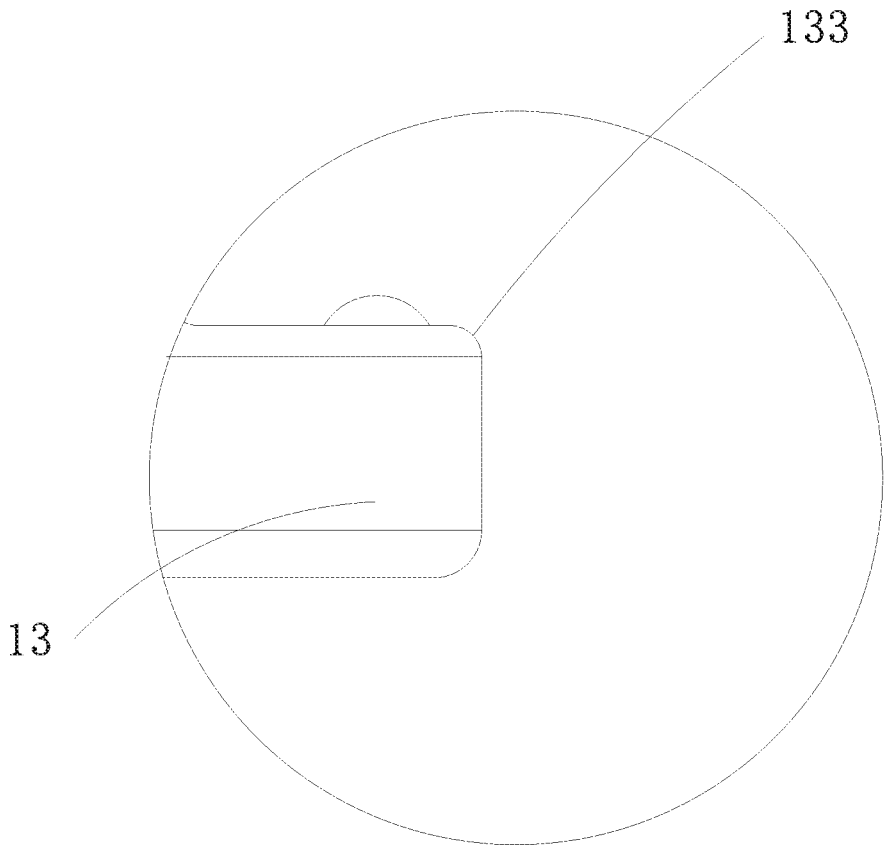
FIG. 9 is an enlarged view at "B" in FIG. 2.

Further, as shown in FIGS. 8 and 9, a lateral side of the first fixing plate 12 facing the electronic device 2 is provided with a third chamfer 123, and a lateral side of the second fixing plate 13 facing the electronic device 2 is provided with a fourth chamfer 133. During connecting the connecting structure 1 to the tablet computer 2, the chamfers have a guiding function.

Figure 2:
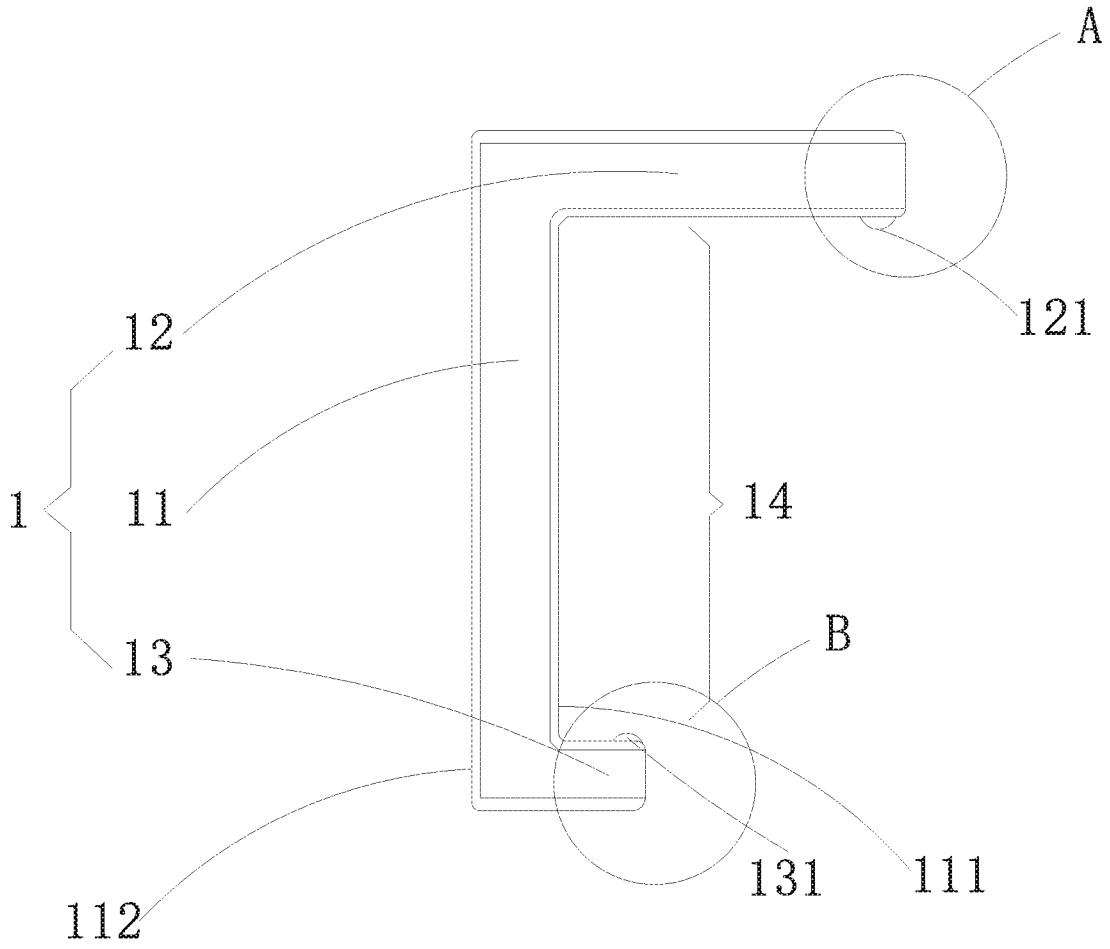
FIG. 2 is a left view of the connecting structure provided in the first embodiment of the present invention.
Figure 3:
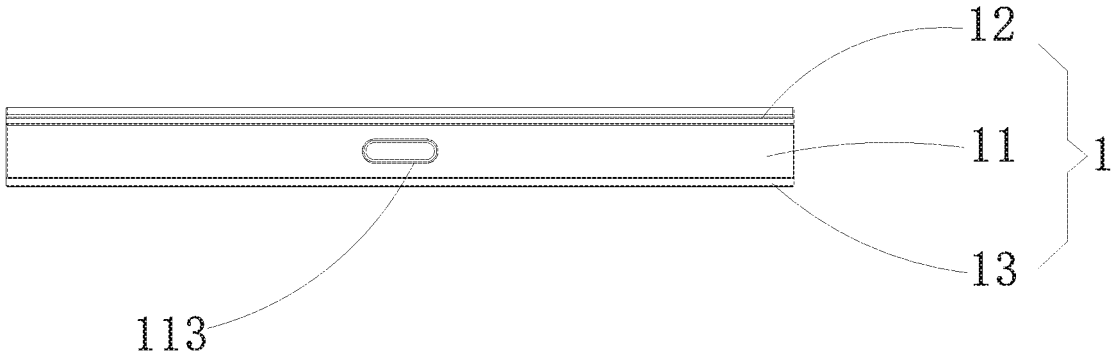
FIG. 3 is a front view of the connecting structure provided in the first embodiment of the present invention.
Figure 10:
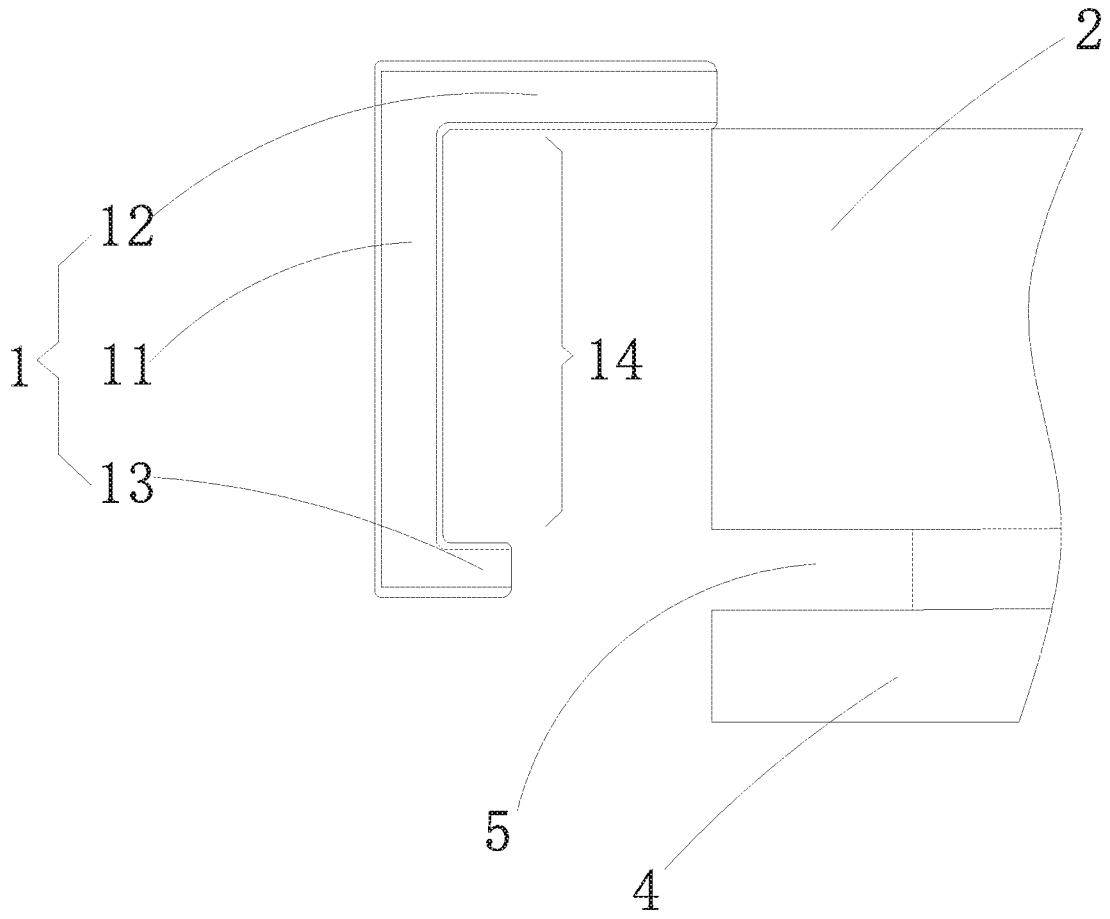
FIG. 10 is a schematic diagram of the installation of the connecting structure provided in the first embodiment of the present invention with an electronic device and a keyboard assembly.

Further, referring to FIGS. 2 and 10 at the same time, the length of the first fixing plate 12 in the protruding direction is greater than the length of the second fixing plate 13 in the protruding direction. During the insertion, a user can first arrange the longer first fixing plate 12 to abut against the upper surface of the end of the tablet computer 2, and then insert the connecting structure 1 into an interface of the tablet computer 2 in the insertion direction, so as to avoid the difficulty in insertion due to the small notch of the accommodating slot 14, for the insertion of the end of the tablet computer 2, formed by the first fixing plate 12 and the second fixing plate 13 that have the same length. In addition, since the existing tablet computers 2 are all equipped with a keyboard assembly 4, and the keyboard assembly 4 is arranged on a lower surface of the tablet computer 2 and overlapped with the tablet computer 2 so as to form a gap 5 small in depth between the keyboard assembly 4 and the tablet computer 2, when the connecting structure 1 and the tablet computer 2 are installed, the longer first fixing plate 12 is located above and corresponding to the upper surface of the tablet computer 2, while the shorter second fixing plate 13 is located below and corresponding to the gap 5 between the tablet computer 2 and the keyboard assembly 4, the length of the second fixing plate 13 being adapted to the depth of the gap 5 for making avoidance, the length of the second fixing plate 13 being less than the depth of the gap 5, and the thickness of the second fixing plate 13 being less than the width of the gap 5.

Figure 11:
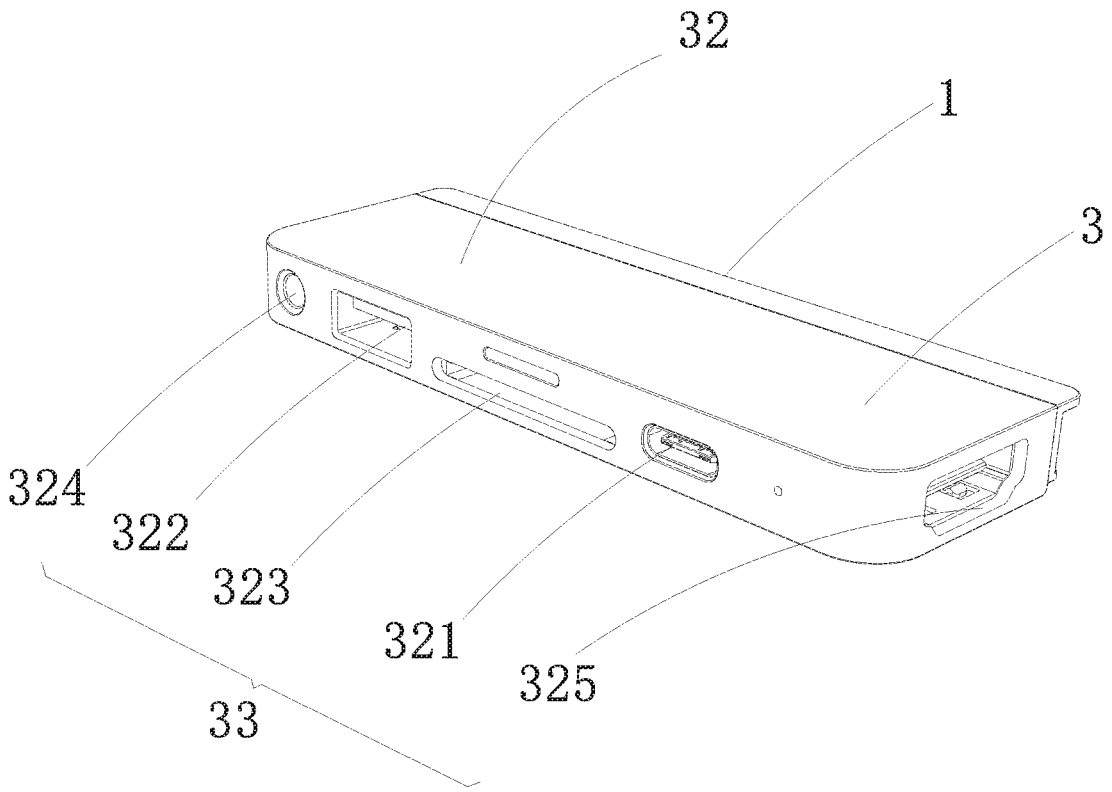
FIG. 11 is a perspective structural view of the adapter provided in the embodiments of the present invention.

As shown in FIG. 11, another object of the present invention is to provide an adapter 3 comprising the connecting structure 1 as described above and an adapter apparatus 32 fixedly connected to the connecting structure 1, the adapter apparatus 32 being provided with an interface apparatus 33 and a plug 31 connected to the interface apparatus 33.

Further, the plug 31 protrudes towards the electronic device 2 and protrudes out of the end of the first fixing plate 12 by 2 mm to 5 mm.

Further, the methods for fixing the connecting structure 1 to the adapter 3 include fixing with an adhesive, snap-fit fixing, fixing with a screw, or fixing by welding.

Further, the interface apparatus 33 comprises a USB-Type-C interface 321, a USB-Type-B interface 322, a TF card interface 323, an audio interface 324 and an HDMI interface 325 or one or more of the above interfaces.

The above embodiments are merely preferred embodiments of the present invention but not intended to limit the present invention, and any modifications, equivalent replacements, improvements, etc. made within the spirit and principle of the present invention should be included within the scope of protection of the present invention.

The invention claimed is:

1. A connecting structure comprising:

a connecting plate that has a first surface configured to abut with an electronic device and a second surface configured to abut with an adapter;

a first fixing plate arranged at a first end of the connecting plate, the first fixing plate protruding towards the electronic device from the first surface; and a second fixing plate arranged at a second end of the connecting plate opposite to the first end, the second fixing plate protruding towards the electronic device from the first surface, wherein a length of the second fixing plate in the protruding direction is shorter than a length of the first fixing plate in the protruding direction;

wherein the second fixing plate is arranged opposite to the first fixing plate, to define an accommodating slot for receiving an end of the electronic device having an interface positioned in the accommodating slot, and wherein the second fixing plate is configured to adapt to a gap of the electronic device when the end of the electronic device is received in the accommodating slot; and wherein the connecting plate defines a hole through which a plug protrudes towards the electronic device.

2. The connecting structure of claim 1, wherein the first fixing plate is inclined relative to the connecting plate, and the second fixing plate is inclined relative to the connecting plate.

3. The connecting structure of claim 2, wherein the first fixing plate is arranged to protrude inward with respect to the accommodating slot, and the second fixing plate is arranged to protrude inward with respect to the accommodating slot.

4. The connecting structure of claim 2, wherein the first fixing plate is parallel to the second fixing plate, and the first fixing plate is arranged to protrude outwards with respect to the accommodating slot.

5. The connecting structure of claim 2, wherein the first fixing plate is parallel to the second fixing plate, and the first fixing plate is arranged to protrude towards inside of the accommodating slot.

6. The connecting structure of claim 2, wherein the first fixing plate is parallel to the second fixing plate, and the first fixing plate and the second fixing plate are respectively arranged perpendicular to the connecting plate.

7. The connecting structure of claim 1, wherein the first fixing plate is provided with a first fixing protrusion towards an inside of the accommodating slot, and the second fixing plate is provided with a second fixing protrusion towards the inside of the accommodating slot.

8. The connecting structure of claim 1, wherein a corner of the first fixing plate is provided with a first chamfer, and a corner of the second fixing plate is provided with a second chamfer.

9. The connecting structure of claim 1, wherein a lateral side of the first fixing plate facing the electronic device is provided with a third chamfer, and a lateral side of the second fixing plate facing the electronic device is provided with a fourth chamfer.

10. A connecting structure comprising:

a connecting plate that has a first surface configured to abut with an electronic device and a second surface configured to abut with an adapter;

a first fixing plate arranged at a first end of the connecting plate, the first fixing plate protruding towards the electronic device from the first surface; and a second fixing plate arranged at a second end of the connecting plate opposite to the first end, the second fixing plate protruding towards the electronic device from the first surface;

wherein the second fixing plate is arranged opposite to the first fixing plate, to define an accommodating slot for receiving an end of the electronic device having an interface positioned in the accommodating slot;

wherein the connecting plate defines a hole through which a plug protrudes towards the electronic device; and wherein the electronic device comprises two overlapped components with a gap formed therebetween, a length of the first fixing plate in the protruding direction is greater than a length of the second fixing plate in the protruding direction, and the length of the second fixing plate is less than a depth of the gap.

11. The connecting structure of claim 10, wherein the thickness of the second fixing plate is less than a width of the gap of the electronic device.

12. The connecting structure of claim 10, wherein the first fixing plate is inclined relative to the connecting plate, and the second fixing plate is inclined relative to the connecting plate.

13. The connecting structure of claim 10, wherein the first fixing plate is provided with a first fixing protrusion towards an inside of the accommodating slot, and the second fixing plate is provided with a second fixing protrusion towards the inside of the accommodating slot.

14. The connecting structure of claim 12, wherein the first fixing plate is arranged to protrude inward with respect to the accommodating slot, and the second fixing plate is arranged to protrude inward with respect to the accommodating slot.

15. The connecting structure of claim 12, wherein the first fixing plate is parallel to the second fixing plate, and the first fixing plate is arranged to protrude outwards with respect to the accommodating slot.

16. The connecting structure of claim 12, wherein the first fixing plate is parallel to the second fixing plate, and the first fixing plate is arranged to protrude towards inside of the accommodating slot.

17. An adapter comprising:

a connecting structure comprising:

a connecting plate that has a first surface configured to abut with an electronic device and a second surface configured to abut with an adapter;

a first fixing plate arranged at a first end of the connecting plate, the first fixing plate protruding towards the electronic device from the first surface; and a second fixing plate arranged at a second end of the connecting plate opposite to the first end, the second fixing plate protruding towards the electronic device from the first surface, wherein a length of the second fixing plate in the protruding direction is shorter than a length of the first fixing plate in the protruding direction;

wherein the second fixing plate is arranged opposite to the first fixing plate, to define an accommodating slot for receiving an end of the electronic device having an interface positioned in the accommodating slot, and wherein the second fixing plate is configured to adapt to a gap of the electronic device when the end of the electronic device is received in the accommodating slot; and wherein the connecting plate defines a hole through which a plug protrudes towards the electronic device; and an adapter apparatus fixedly connected to the connecting structure, the adapter apparatus being provided with an interface apparatus and a plug connected to the interface apparatus.

18. The adapter of claim 17, wherein the plug protrudes out of an end of the first fixing plate by 2 mm to 5 mm.

19. The adapter of claim 17, wherein the connecting structure is fixed to the adapter apparatus with an adhesive, snap-fit fixing, a screw, or welding.

20. The adapter claim 17, wherein the interface apparatus comprises at least a USB-Type-C interface, a USB-Type-B interface, a TF card interface, an audio interface or an HDMI interface.

* * * * *